US006024025A

United States Patent [19]

Koch et al.

[11] Patent Number: 6,024,025

[45] Date of Patent: Feb. 15, 2000

[54] TABLE LIFT MECHANISM

[75] Inventors: Richard L. Koch, Keller; Trever L. Barnett, Lewisville, both of Tex.

[73] Assignee: Equipto, Dallas, Tex.

[21] Appl. No.: 09/245,467

[22] Filed: Feb. 5, 1999

[51] Int. Cl.[7] ..... A47B 9/00

[52] U.S. Cl. ..... 108/147; 312/306; 74/509

[58] Field of Search ..... 108/147, 144; 312/306, 408, 312; 211/207; 74/89.15, 509, 16, 507, 89.13, 89.16

[56] References Cited

U.S. PATENT DOCUMENTS

| | | | |
|---|---|---|---|
| 2,841,459 | 7/1958 | Sharpe | 312/306 |
| 2,861,695 | 11/1958 | Carbary | 312/306 |
| 3,253,284 | 5/1966 | St. John | 108/147 |
| 4,590,865 | 5/1986 | Rütsche et al. . | |
| 4,747,353 | 5/1988 | Watt . | |
| 5,083,514 | 1/1992 | Schwartz et al. . | |
| 5,199,778 | 4/1993 | Aoki et al. | 108/147 |
| 5,370,063 | 12/1994 | Childers . | |
| 5,408,940 | 4/1995 | Winchell . | |
| 5,447,099 | 9/1995 | Adams et al. . | |
| 5,549,053 | 8/1996 | Grout . | |
| 5,685,510 | 11/1997 | Frankish . | |
| 5,718,406 | 2/1998 | Long . | |

*Primary Examiner*—Peter M. Cuomo
*Assistant Examiner*—Gerald A. Anderson
*Attorney, Agent, or Firm*—Hill & Simpson

[57] ABSTRACT

A lift table mechanism has a thread screw secured upright within a support tube; a driven nut threadedly mounted to the screw which is raised and lowered by rotating around the thread screw; a carriage frame attached to the nut and supporting a table surface; a drive engaging a main driver gear connected to the drive; and an idler gear coupled to the main driver gear and in turn engaging the nut. Alternatively, a cross shaft driver is rotatably coupled between the main driver gear and the idler gear; a cross shaft connects cross shaft drivers of multiple table lift mechanisms wherein the cross shaft drivers rotate concurrently.

14 Claims, 2 Drawing Sheets

TABLE LIFT MECHANISM

BACKGROUND OF THE INVENTION

1. Field of the Invention

The present invention is directed to a table lift mechanism.

2. Description of the Prior Art

As is known, table lift mechanisms are commonly used on adjustable height work tables. Table lift mechanisms fulfill an ergonomic need for work surfaces to be height adjustable to accommodate workers of different heights and for the performance of different tasks.

In many embodiments, adjustable height work tables are supported either at each of their corners or cantilevered from supports at their rear two corners. The table height is adjusted through a table lift mechanism, which either extends and retracts the height of the supports to which the work surface is affixed or raises and lowers the work surface along fixed supports. Such table lift mechanisms have been formed by gear trains mounted to the supports. The table includes a rotatable drive shaft for engaging the gears mounted to the supports thereby to adjust the vertical position of the work surface. In one known embodiment, a table lift mechanism includes a rotatable drive shaft with a pinion gear for engaging a gear rack on the vertical support. In another known embodiment, a vertical linear drive comprises an elongated screw and a rotatable nut assembly, wherein a rotatable drive shaft engages the nut.

It is desirable to maintain a level work surface when its height is adjusted. This is achieved by incorporating a table lift mechanism at each support and simultaneously driving the gears within the lift mechanisms. A single rotatable drive shaft can be used to simultaneously actuate each lift mechanism by connecting cross shafts between gears within each table lift mechanism. Accordingly, one of the table lift mechanisms is driven by the rotatable drive shaft and torque is transferred to the table lift mechanisms at the other supports through the cross shafts, thereby simultaneously adjusting the height of each table lift mechanism.

In many of the known embodiments, a rotatable drive shaft directly engages a linear rack or a driven nut coupled to a screw. Consequently, these arrangements produce a high torque on the rotatable drive shaft to drive the linear rack or nut to which the rotatable drive shaft is directly coupled and further to drive the linear racks or nuts located on other supports to which it is coupled through a cross shaft. As a result, a direct coupling is prohibitive.

Further, in the known embodiments, the adjustment range of the table height is limited by the travel in the lifting mechanism. This range is typically 12 inches to 18 inches.

Further, existing table lift mechanisms do not allow for installation of one or more work surfaces on one set of supports, with both mounting systems having independent height adjustment.

SUMMARY OF THE INVENTION

The present application provides one or more inventions directed to improvements in table lift mechanisms. These improvements can be provided in a single all-encompassing unit or practiced separately.

To this end, in an embodiment, there is provided a table lift mechanism having an adjustable thread screw secured upright within an upright support. A driven nut is threadedly mounted to the thread screw such that the nut is raised and lowered by rotating around the thread screw. A carriage frame is attached to the nut and fits within a channel of the upright support. A detachable bench top is supported on the carriage frame. A user adjusts the table height by actuating a drive. The drive engages a main driver gear. The main driver gear engages an idler gear, which in turn engages the nut, causing the nut to rotate around the thread screw. As a result of including an idler gear between the main driver gear and the threaded nut, the present invention is not subject to the mechanical constraints of known mechanisms having a main driver gear directly coupled to a driven nut or linear rack.

Further, the adjustment range of the table height is not limited by the travel in the lifting mechanism because the thread screw can be positioned at any height within the length of the upright support tube.

Further, as the carriage frame fits entirely within an upright support tube and multiple table lift mechanisms can be mounted to an upright support tube, the present invention allows for installation of one or more work surface on one set of supports, with both mounting systems having independent height adjustment.

In an embodiment, the table lift mechanism further includes a cross shaft driver rotatably connected between the main driver gear and the idler gear. Two such table lift mechanisms are provided, with a cross shaft connected between the respective cross shaft drivers of the two table lift mechanisms. This cross shaft is disposed along a common axis of the cross shaft drivers. Torque is thus transferred from one table lift mechanism to the other, which results in the cross shaft drivers rotating concurrently. As a result, the present invention provides a table lift mechanism that enables level motion of the table surface while requiring substantially less work to actuate the drive.

These and other features of the invention(s) will become clearer with reference to the following detailed description of the presently preferred embodiments and accompanied drawings.

DESCRIPTION OF THE PREFERRED EMBODIMENTS

Figure 1:
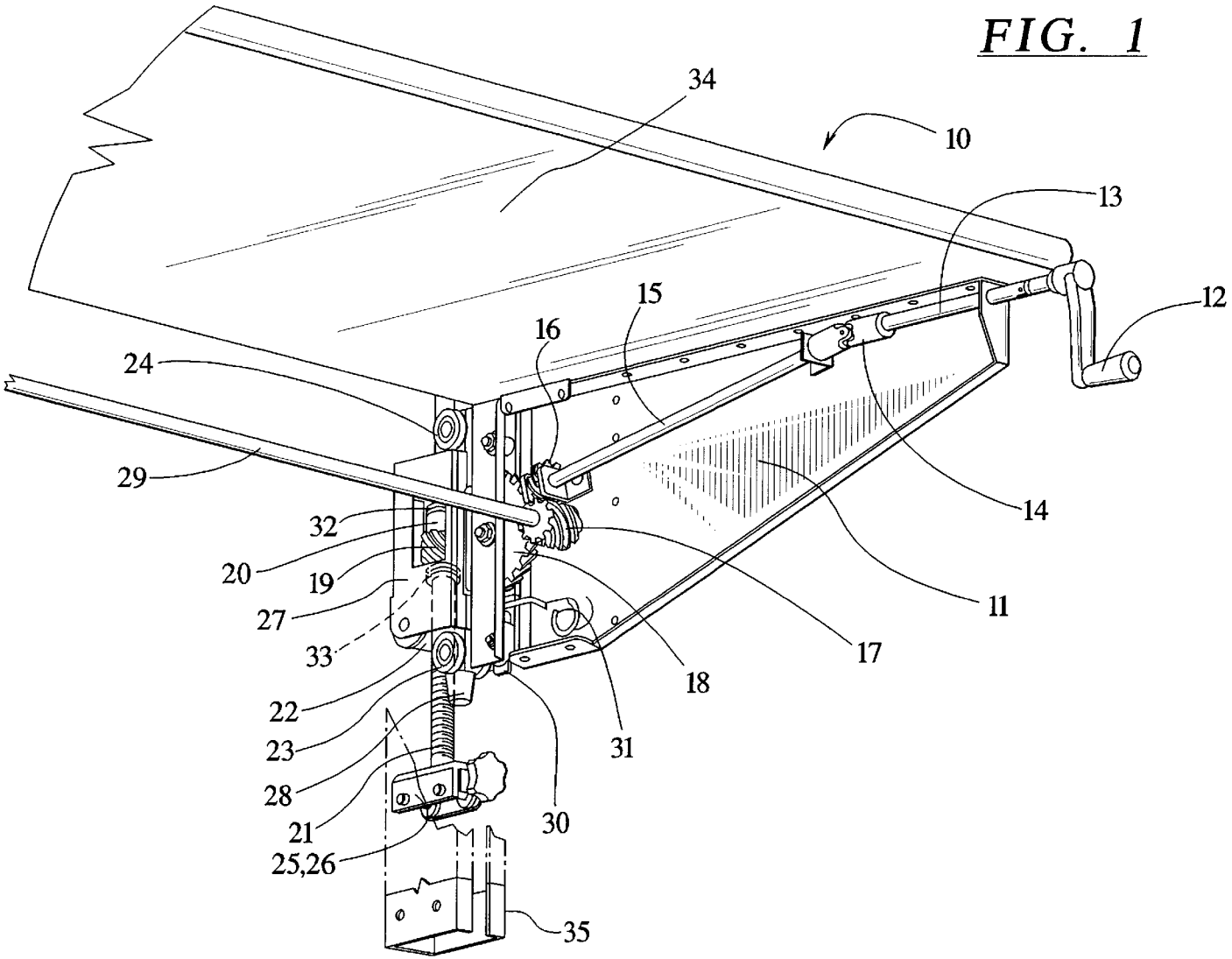
FIG. 1 is a perspective view of a table lift mechanism embodying principles of the present invention(s).
Figure 2:
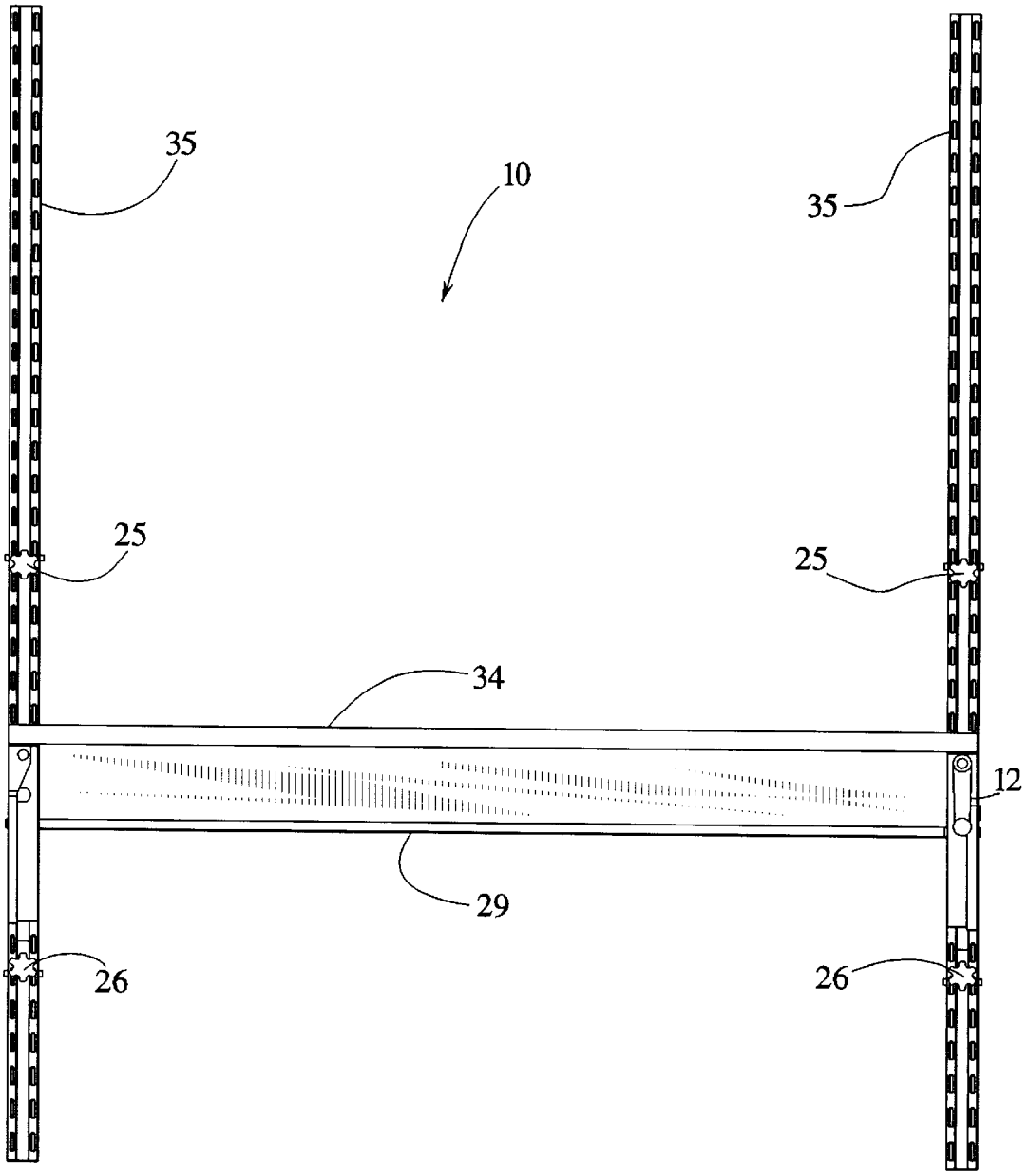
FIG. 2 is a front view of two table lift mechanisms mounted to two vertical supports and supporting a bench top.

In FIG. 1, there is illustrated a table lift mechanism 10 that can embody the principles of the present invention. As illustrated, the table lift mechanism 10 is mounted to an upright support 35. The upright support 35 is a "c"-section formed rectangular tube with return flanges 36 formed onto the ends of the "c" arms 37. In the preferred embodiment, the upright support 35 has a 2 inch by 4 inch cross-section and can be any desired length greater than 2 feet. In the preferred embodiment, table lift mechanisms 10 are mounted to two upright supports 35 and a bench top 34 is cantilevered from the table lift mechanisms 10 (FIG. 2). However, a single upright support 35 can be used. Alternatively, an upright support 35 can be used to support a table lift mechanism 10 at each corner of a bench top 34.

A thread screw 21 is vertically supported inside the "c"-section formed upright support 35 by upper and lower locating plates 25 and 26, which attach to the upright support 35 and prevent the thread screw 21 from turning. In the preferred embodiment, the thread screw 21 is an Acme ¾-10 thread screw. A driven helical nut 20 is threadedly engaged to the thread screw 21 such that the nut 20 is raised and lowered by rotating around the thread screw 21. The nut 20 has a 45-degree helical gear 19 formed thereon which is concentric to the thread screw 21. Preferably, the nut 20 is an Acme nut.

A carriage frame 27 is attached to the nut 20 and fits within the "c"-section formed upright support 35. A helical idler gear 18 is vertically aligned and rotatably connected to the carriage frame 27 and threadedly engaged with the helical gear 19 formed on the nut 20.

A removable bench top mounting bracket 11 for supporting a bench top 34 is releasably connected to the carriage frame 27. In an embodiment of the invention, the top mounting bracket 11 is secured to the carriage frame 27 via a rotary latch 30. A user releases the rotary latch 30, disconnecting the top mounting bracket 11 from the carriage frame 27, by actuating a latch release 31.

A user controls raising and lowering of the bench top 34 through an actuator 12. In the preferred embodiment, the actuator 12 is a hand crank 12 coupled to a second input shaft 13, which is rotatably connected to the top mounting bracket 11. Clockwise rotation of the hand crank 12 results in raising the bench top 34. Counterclockwise rotation of the hand crank 12 results in lowering the bench top 34. In another embodiment, the actuator 12 is an electric motor, wherein a user presses an electrical switch for correct direction of motion. The second input shaft 13 is hingedly coupled through a universal joint to a first input shaft 15, which is also rotatably connected to the top mounting bracket 11. The first input shaft 15 connects to a helical main driver gear 16. The main driver gear 16 threadedly engages a helical cross shaft driver 17, which is rotatably connected to the top mounting bracket 11. The cross shaft driver 17 in turn threadedly engages the idler gear 18.

In operation, a user rotates the hand crank 12 which when turned rotates the second input shaft 13, turning the first input shaft 15, turning the main driver 16, turning the cross shaft driver 17, turning the idler gear 18, turning the nut 20, which is raised or lowered as it rotates about the fixed position threaded screw 21. As the nut 20 raises or lowers, the carriage frame 27, which is connected to the nut 20, raises or lowers and the bench top 34, which is connected to the carriage frame 27, raises or lowers. Upper and lower thrust bearings 32 and 33 are connected to the top and bottom of the nut 20 to assist travel.

Due to mechanical friction, known table lift mechanisms having a main driver gear was directly coupled to a driven nut typically required a large amount of force to rotate the actuator. Electric motors were typically used in this regard. In order to easily turn a table lift mechanism actuator, it is desirable to reduce the mechanical friction between the main driver gear and the driven nut.

In this regard, a feature of the invention to that end, is the reduction of such mechanical friction between a main driver gear and a driven nut. In the preferred embodiment, the invention inventively solves this problem by rotatably connecting an idler gear between the main driver gear and the driven nut.

The carriage frame 27 is supported in the upright position within the upright support 35 by front and back guide rollers 24 and 22 on opposite sides of the threaded screw 21 and tensioning roller 23. The front and back guide rollers 24 and 22 are rotatably connected in a fixed position to the carriage frame 27. The tensioning roller 23 is adjustable with spring pre-load to minimize slack in the carriage frame 27 to establish a constant compression loading between the teeth of the threaded screw 21 and the nut 20 to prevent binding during operation. A bump stop 28 is connected to the bottom edge of the carriage frame 27 to absorb impact when the table lift mechanism 10 is adjusted to its lowest height position.

When table lift mechanisms 10 are used in two upright supports 35 (See FIG. 2) a cross shaft 29 is rigidly connected between the cross shaft drivers 17 and lies along a common axis of rotation of the cross shaft drivers 17. The cross shaft 29 transfers torque from the table lift mechanism 10 driven by the actuator 12 to the table lift mechanism 10 on the opposite side of the cross shaft 29. The cross shaft drivers 17 of each table lift mechanism 10 rotate uniformly, resulting in synchronous raising and lowering of each table lift mechanism 10. Consequently, a bench top 34 that spans the distance between the two upright supports 35 remains level during height adjustment.

In an embodiment, when one table lift mechanism 10 is used in a single upright support 35, the table lift mechanism 10 does not include a cross shaft driver 17. The main driver gear 16 directly engages the idler gear 18.

Height adjustments of a range greater than those allowed by the table lift mechanism 10 are inventively accomplished by detaching the bench top 34 from the lift table mechanisms 10, releasing the thread screw 21 locating plates 25 and 26, adjusting the table lift mechanisms 10 to the height desired, securing the locating plates 25 and 26 to the upright supports 35, and then reattaching the bench top 34 to the table lift mechanisms 10.

Referring to FIG. 2, a bench top 34 spans the distance between two upright supports 35 and is attached to a table lift mechanism 10 mounted within each upright support 35. A hand crank 12 located on the rightmost upright support 35 illustrates an actuator 12 used to adjust the bench top 34 height. A cross shaft 29 spans the distance between the table lift mechanisms 10 and connects to a cross shaft driver 17 (not shown) within each table lift mechanism 10. When a user rotates the hand crank 12, which mechanically engages the rightmost table lift mechanism 10, torque is transferred through the cross shaft 29 to the leftmost table lift mechanism 10. Accordingly, the table lift mechanisms 10 travel simultaneously. As a result, the bench top 34 remains level during height adjustment.

Upper and lower locating plates 25 and 26 attach to the upright supports 35 and prevent the thread screws 21 from turning.

The foregoing eliminates the mechanical friction constraints and height adjustment limitations associated with previously known table lift mechanisms by incorporating an idler gear 18 between the main driver gear 17 and the driven nut 20 and by incorporating an adjustable thread screw 21.

Although modifications and changes may be suggested by those of ordinary skill in the art, it is the intention of the inventor to embody within the patent warranted hereon all changes and modifications as reasonably and properly come within the scope of his contribution to the art.

We claim as our invention:

1. A table lift mechanism comprising:

at least one upright support;

a thread screw secured upright within said upright support;

a driven nut threadably mounted to said thread screw, said driven nut raising and lowering by rotating around said thread screw;

a carriage frame attached to said driven nut;

a table surface supported by said carriage frame;

a drive engaging a main driver gear, said drive connected to said table surface; and an idler gear rotatably connected to said main driver gear, said idler gear engaging said driven nut.

2. The table lift mechanism as claimed in claim 1, further comprising a cross shaft driver rotatably supported on said table surface and rotatably connected between said main driver and said idler gear.

3. The table lift mechanism as claimed in claim 1, wherein said upright support has a c-shape.

4. The table lift mechanism as claimed in claim 1, wherein said table surface is detachable from said carriage frame.

5. The table lift mechanism as claimed in claim 1, wherein said at least one upright support comprises two upright supports, said upright supports being spaced apart to support said table surface.

6. The table lift mechanism as claimed in claim 1, wherein said drive includes an actuator mounted to said table and a drive shaft having first and second ends rotatably coupled to said actuator at said first end of said drive shaft, said drive shaft rotatably coupled to said main driver gear at said second end of said drive shaft.

7. The table lift mechanism as claimed in claim 6, wherein said actuator is a hand crank.

8. The table lift mechanism as claimed in claim 6, wherein said actuator is a motor.

9. The table lift mechanism as claimed in claim 1, wherein each of said at least one upright supports includes:

a thread screw secured upright within said upright support;

a driven nut threadably mounted to said thread screw, said driven nut raising and lowering by rotating around said thread screw;

a carriage frame attached to said driven nut;

an idler gear engaging said driven nut; and a cross shaft driver rotatably connected to said idler gear.

10. The table lift mechanism as claimed in claim 9, further comprising a cross shaft connected to said cross shaft drivers on each of said upright supports, wherein said cross shaft drivers rotate concurrently.

11. The table lift mechanism as claimed in claim 10, wherein one of said cross shaft drivers is driven by said main driver gear and said other cross shaft driver is driven by said cross shaft.

12. The table lift mechanism as claimed in claim 1, wherein said idler gear is rotatably supported on said carriage frame.

13. The table lift mechanism as claimed in claim 1, wherein said idler gear is rotatably supported on said table surface.

14. The table lift mechanism comprising:

at least one upright support;

a thread screw secured upright within said upright support;

a driven nut threadably mounted to said thread screw, said driven nut raising and lowering by rotating around said thread screw;

a carriage frame attached to said driven nut;

a table surface supported by said carriage frame;

a drive engaging a main driver gear, said drive connected to said table surface;

a cross shaft driver rotatably supported on said table surface and rotatably connected to said main driver gear; and an idler gear rotatably connected to said cross shaft driver, said idler gear engaging said driven nut.

* * * * *